US010001744B2

(12) United States Patent
Araishi

(10) Patent No.: US 10,001,744 B2
(45) Date of Patent: Jun. 19, 2018

(54) IMAGE FORMING APPARATUS

(71) Applicant: KYOCERA Document Solutions Inc., Osaka (JP)

(72) Inventor: Kuniaki Araishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/473,777

(22) Filed: Mar. 30, 2017

(65) Prior Publication Data

US 2017/0293252 A1 Oct. 12, 2017

(30) Foreign Application Priority Data

Apr. 7, 2016 (JP) ..... 2016-077124

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC .... G03G 21/1633; G03G 15/08; G03G 21/00; G03G 21/1842; G03G 2215/0692
See application file for complete search history.

(56) References Cited

U.S. PATENT DOCUMENTS 5,937,240 A * 8/1999 Kanno ..... G03G 21/1853 399/111
9,360,797 B1 * 6/2016 Bayubay ..... G03G 15/0865
2002/0181969 A1 * 12/2002 Terada ..... G03G 21/1853 399/111
2003/0156856 A1 * 8/2003 Arimitsu ..... G03G 21/1825 399/114
2010/0046979 A1 * 2/2010 Lee ..... G03G 21/1633 399/90
2013/0170864 A1 * 7/2013 Newman ..... G03G 15/0886 399/258
2014/0241758 A1 * 8/2014 Rulon ..... G03G 15/08 399/260

FOREIGN PATENT DOCUMENTS

JP 2014-232223 A 12/2014

* cited by examiner

*Primary Examiner* — Francis Gray
(74) *Attorney, Agent, or Firm* — Studebaker & Brackett PC

(57) ABSTRACT

An image forming apparatus includes a casing, an image forming unit, a plurality of covers, a shutter, and a linkage mechanism. The image forming unit includes a light source and is disposed in an interior of the casing. The image forming unit forms an image on a recording medium. The covers are openable and closable relative to the casing. The shutter is openable and closable relative to the light source. The linkage mechanism links the respective covers to the shutter. The linkage mechanism sets the shutter in a closed state in a situation in which at least one of the covers is in an open state and sets the shutter in an open state in a situation in which all the covers are in a closed state.

9 Claims, 14 Drawing Sheets

IMAGE FORMING APPARATUS

INCORPORATION BY REFERENCE

The present application claims priority under 35 U.S.C. § 119 to Japanese Patent Application No. 2016-077124, filed on Apr. 7, 2016. The contents of this application are incorporated herein by reference in their entirety.

BACKGROUND

The present disclosure relates to image forming apparatuses.

A certain image forming apparatus includes a casing, an optical scanning device, an upper cover, a front cover, a shutter, and a linkage member. The upper cover and the front cover each are openable and closable relative to the casing. The shutter is openable and closable relative to the optical scanning device. When the upper cover is opened, the linkage member closes the shutter. When the upper cover is closed, the linkage member opens the shutter. The shutter in a closed state blocks a light path of a laser emitted from the optical scanning device.

SUMMARY

An image forming apparatus according to the present disclosure includes a casing, an image forming unit, a plurality of covers, a shutter, and a linkage mechanism. The image forming unit includes a light source and is disposed in an interior of the casing. The image forming unit forms an image on a recording medium. The covers are openable and closable relative to the casing. The shutter is openable and closable relative to the light source. The linkage mechanism links the respective covers to the shutter. The linkage mechanism sets the shutter in a closed state in a situation in which at least one of the covers is in an open state and sets the shutter in an open state in a situation in which all the covers are in a closed state.

DETAILED DESCRIPTION

Figure 1:
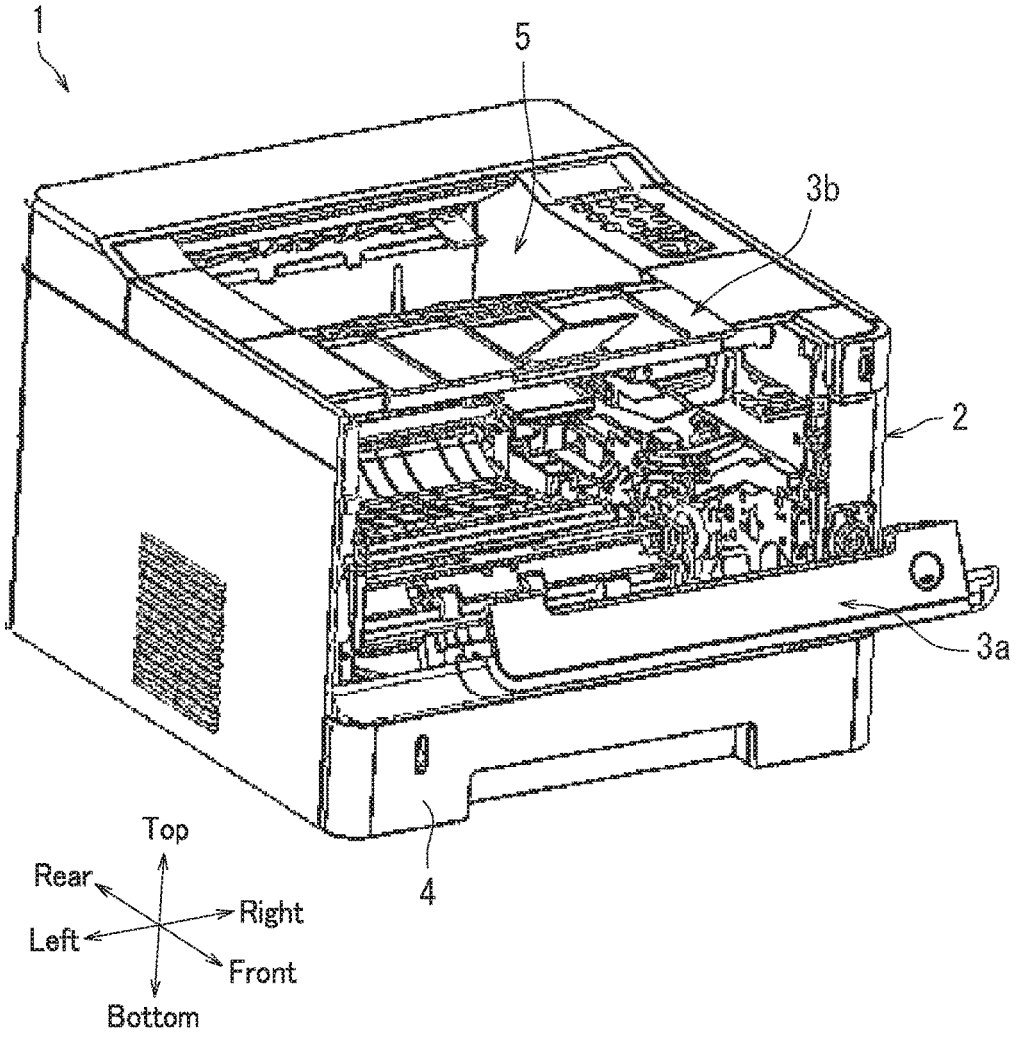
FIG. 1 is a perspective view illustrating an image forming apparatus according to an embodiment of the present disclosure.

The following explains an embodiment of the present disclosure with reference to the drawings. It is noted that the present disclosure is not limited to the following embodiments. Elements in the drawings that are the same or equivalent are marked by the same reference signs. Furthermore, explanation of such elements is not repeated.

Explanation is given below of an image forming apparatus 1 according to an embodiment of the present disclosure with reference to FIGS. 1-14. FIG. 1 is a perspective view illustrating the image forming apparatus 1 according to the embodiment of the present disclosure. The image forming apparatus 1 in the present embodiment is a printer. The image forming apparatus 1 forms an image on a recording medium. Note that the image forming apparatus 1 may be a copier, a facsimile machine, or a multifunction peripheral.

As illustrated in FIG. 1, the image forming apparatus 1 includes a casing 2 and two covers 3*a* and 3*b*. The casing 2 has a substantially box-like rectangular parallelepiped shape. Hereinafter, the cover 3*a* is referred to as a first cover 3*a* and the cover 3*b* is referred to as a second cover 3*b*.

In the present embodiment, a front-to-rear direction is defined by defining a surface of the image forming apparatus 1 on which the first cover 3*a* is mounted in FIG. 1 as a front surface thereof. Also, an up-and-down direction is defined by defining a surface of the image forming apparatus 1 on which the second cover 3*b* is mounted as a top surface thereof. A direction perpendicular to the front-to-rear direction and the up-and-down direction is defined as a left-right direction.

Figure 2:
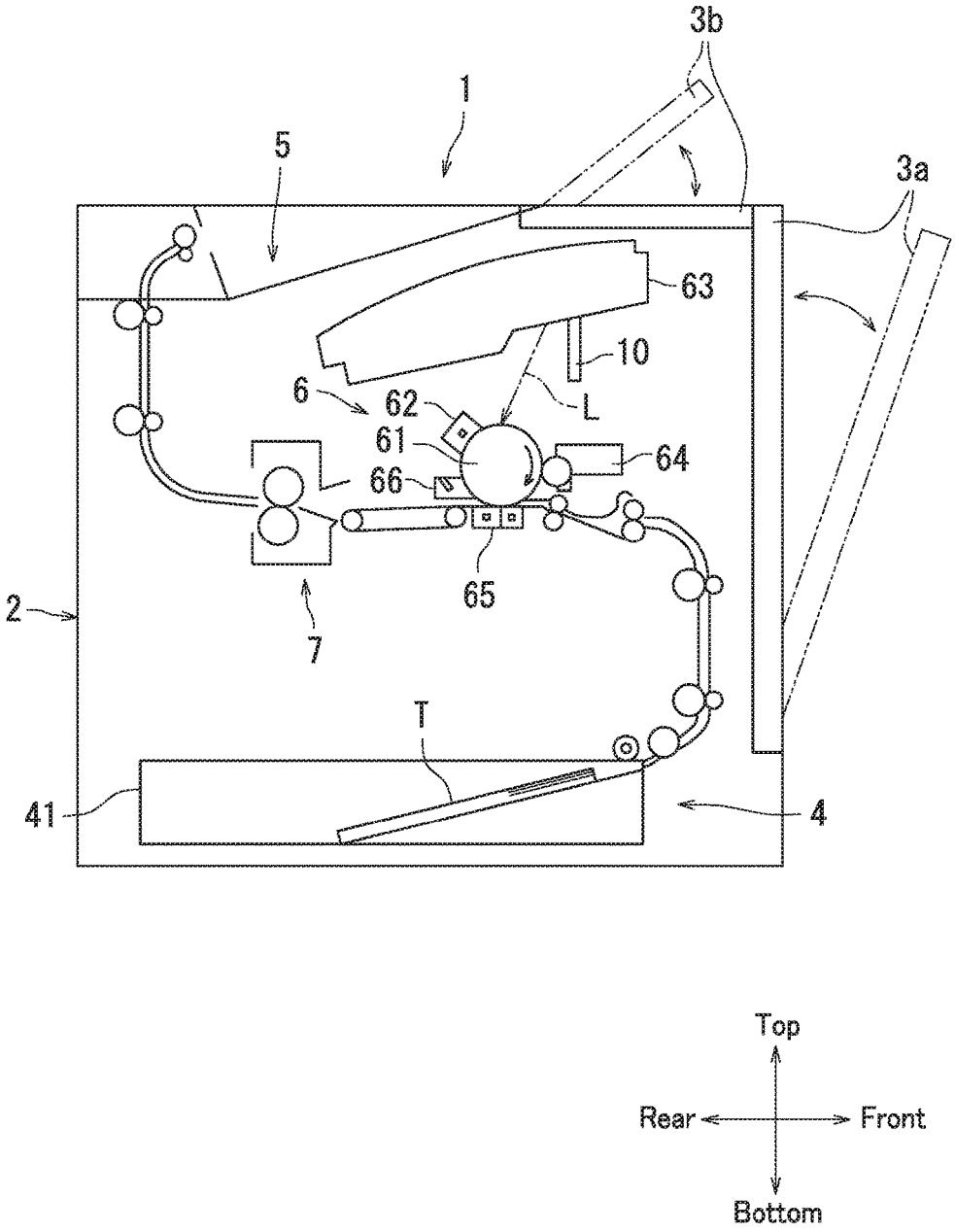
FIG. 2 schematically illustrates configuration of the image forming apparatus in FIG. 1.

FIG. 2 schematically illustrates configuration of the image forming apparatus 1 in FIG. 1. As illustrated in FIG. 2, the image forming apparatus 1 forms an image on a recording medium such as a sheet T. Sheets T are for example plain paper, copy paper, recycled paper, thin paper, thick paper, glossy paper, or overhead projector (OHP) sheets.

The first cover 3*a* is openable and closable (freely opened and closed) relative to the casing 2. The first cover 3*a* has a rotational axis. The first cover 3*a* is mounted on the casing 2 pivotally about the rotational axis. The first cover 3*a* is supported to the casing 2 in a pivotal manner about the rotational axis. The rotational axis is located at a lower end of the first cover 3*a*. In the above configuration, the first cover 3*a* is openable and closable in the front-to-rear direction about the lower end thereof as a center, as indicated by an imaginary line.

The first cover 3*a* preferably includes a latch mechanism. The latch mechanism keeps the first cover 3*a* in a closed state. Provision of the latch mechanism can prevent unintentional opening of the first cover 3*a*.

The second cover 3*b* is openable and closable (freely opened and closed) relative to the casing 2. The second cover 3*b* has a rotational axis. The second cover 3*b* is mounted on the casing 2 in a pivotal manner about the rotational axis. The second cover 3*b* is supported to the casing 2 in a pivotal manner about the rotational axis. The rotational axis is located at a rear end of the second cover 3*b*. In the above configuration, the second cover 3*b* is openable and closable in the up-and-down direction about the rear end thereof, as indicated by an imaginary line.

In situation in which the first and second covers 3*a* and 3*b* each are in a closed state, a front surface of the second cover 3*b* abuts on an upper end part of the first cover 3*a*. In the above configuration, the second cover 3*b* is openable (capable of transitioning from a closed state to an open state) only in a situation in which the first cover 3*a* is in an open state. Accordingly, it is necessary to open the first cover 3*a* first in order to set the first and second covers 3*a* and 3*b* each in the open state. Note that the first and second covers 3*a* and 3*b* can be closed in any order. The first and second covers 3*a* and 3*b* are opened for maintenance such as replacement of a toner container or jam clearance.

The image forming apparatus 1 further includes an accommodation section 4, an ejection section 5, an image forming section 6 (an example of an image forming unit), a fixing section 7, and a shutter 10. The accommodation section 4, the image forming section 6, the fixing section 7, and the shutter 10 are accommodated in the interior of the casing 2. The sheets T are conveyed one at a time from the accommodation section 4 to the ejection section 5 through a predetermined sheet conveyance path.

The accommodation section 4 includes a cassette 41. The cassette 41 is located in a lower part of the casing 2. The cassette 41 is attachable to and detachable from the image forming apparatus 1 from the front side thereof. The sheets T are loadable on the cassette 41. Note that the accommodation section 4 may have a plurality of cassettes. Furthermore, the accommodation section 4 may include a manual feed tray in addition.

The image forming section 6 forms a toner image on a sheet T. The image forming section 6 includes a photosensitive drum 61, a charger 62, an exposure device 63 that is a light source, a developing device 64, a transfer device 65, and a cleaner 66. The charger 62, the exposure device 63, the developing device 64, the transfer device 65, and the cleaner 66 are located around the photosensitive drum 61 in the stated order in a rotational direction thereof the photosensitive drum 61.

The photosensitive drum 61 is disposed so as to be rotatable. The photosensitive drum 61 includes for example a conductive substrate and a photosensitive layer disposed on an outer circumferential surface of the conductive substrate.

The charger 62 charges the photosensitive drum 61 to a predetermined potential. The exposure device 63 irradiates an outer circumferential surface of the charged photosensitive drum 61 with laser light L. The exposure device 63 forms an electrostatic latent image on the outer circumferential surface of the photosensitive drum 61 using the laser light L. The electrostatic latent image is formed based on image data. The image data is transmitted for example from an external device. The exposure device 63 is disposed above the photosensitive drum 61. The exposure device 63 irradiates the photosensitive drum 61 with the laser light L through a gap between the charger 62 and the developing device 64.

The developing device 64 develops the electrostatic latent image into a toner image. As a result, the toner image is formed on the outer circumferential surface of the photosensitive drum 61. The transfer device 65 forms a transfer nip in cooperation with the photosensitive drum 61. The transfer nip is formed in the sheet conveyance path. The toner image formed on the outer circumferential surface of the photosensitive drum 61 is transferred to the sheet T when the sheet T passes through the transfer nip. The cleaner 66 removes residual toner attached to the photosensitive drum 61 after transfer of the toner image to the sheet T.

The fixing section 7 is disposed downstream of the image forming section 6 in the sheet conveyance path. The fixing section 7 fixes the toner image to the sheet T by applying heat and pressure to the sheet T to which the toner image has been transferred. The sheet T to which the toner image is fixed is ejected onto the ejection section 5.

The shutter 10 is openable and closable relative to the exposure device 63. The shutter 10 in a closed state blocks a light path of the laser light L emitted from the exposure device 63. The shutter 10 in an open state unblocks the light path of the laser light L emitted from the exposure device 63.

The following explains, with reference to FIGS. 3-6, a linkage mechanism 8 that the image forming apparatus 1 includes. The linkage mechanism 8 opens and closes the shutter 10. The linkage mechanism 8 includes a first linkage mechanism 8*a* and a second linkage mechanism 8*b*. The first linkage mechanism 8*a* operates according to opening and closing of the first cover 3*a*. The second linkage mechanism 8*b* operates according to opening and closing of the second cover 3*b*.

Figure 3:
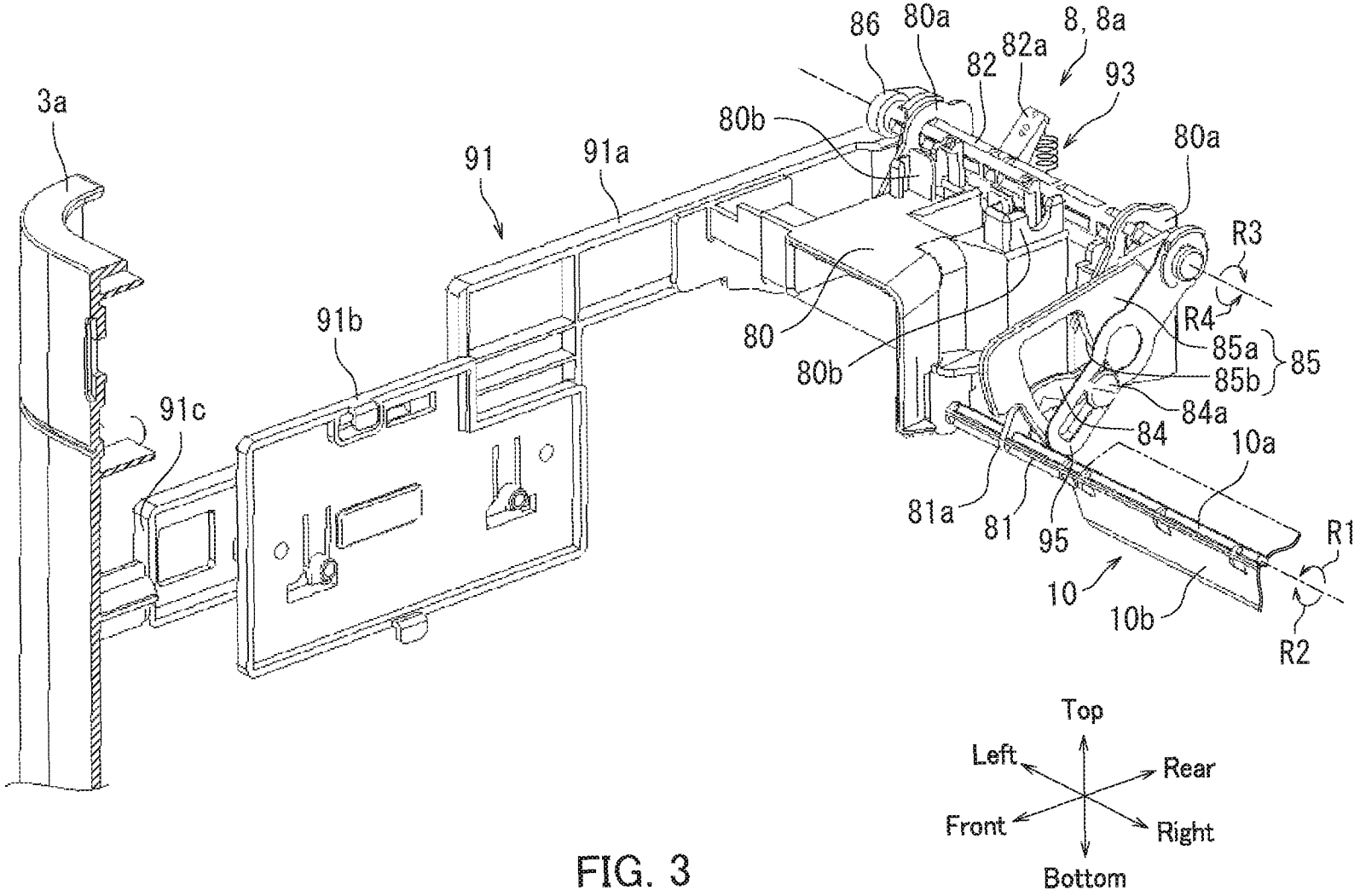
FIG. 3 illustrates configuration of a first linkage mechanism of a linkage mechanism according to the embodiment of the present disclosure.

FIG. 3 illustrates configuration of the first linkage mechanism 8*a*. Specifically, FIG. 3 is a perspective view of the first linkage mechanism 8*a* as viewed downward from the right front. FIG. 3 illustrates the first linkage mechanism 8*a* in a situation in which the first cover 3*a* is in the closed state.

As illustrated in FIG. 3, the shutter 10 includes a flat plate portion 10*b* and a shaft portion 10*a* that is an example of a fourth shaft. The shaft portion 10*a* has an axis extending in the left-right direction. The shaft portion 10*a* is rotatable in a first direction R1 and a second direction R2. The shaft portion 10*a* in the present embodiment rotates in the second direction R2 by an own weight of the shutter 10 (own weight of the flat plate portion 10*b*). The flat plate portion 10*b* is a plate-shaped member extending in an axial direction of the shaft portion 10*a*. The flat plate portion 10*b* swings in the first and second directions R1 and R2 about the shaft portion 10*a* as a swing center in association with rotation of the shaft portion 10*a*.

The shutter 10 transitions from an open state to a closed state by rotation of the shaft portion 10*a* in the first direction R1, as indicted by an imaginary line in FIG. 3. Specifically, rotation of the shaft portion 10*a* in the first direction R1 raises a tip end of the flat plate portion 10*b* rearward. As a result, the shutter 10 is in the closed state to block the light path of the laser light L emitted from the exposure device 63. By contrast, when the shaft portion 10*a* rotates in the second direction R2 by the own weight of the shutter 10, the tip end of the flat plate portion 10*b* moves downward (swings in the second direction R2). As a result, the shutter 10 is in the open state to unblock the light path of the laser light L emitted from the exposure device 63.

The linkage mechanism 8 includes a base 80, a first shaft 81, a second shaft 82, a first lever 84, a second lever 85, a third lever 86, a first push member 91, a first urging member 93, and a holding piece 95. The base 80 includes a pair of first bearings 80*a* and a pair of second bearings 80*b*.

The first linkage mechanism 8*a* links the first cover 3*a* to the shutter 10. When the first cover 3*a* is opened (transitions from the closed state to the open state), the first linkage mechanism 8*a* rotates the shaft portion 10*a* of the shutter 10 in the first direction R1 to set the shutter 10 in the closed state. By contrast, when the first cover 3*a* is closed (transitions from the open state to the closed state), the first linkage mechanism 8*a* sets the shaft portion 10*a* of the shutter 10 rotatable. In other words, the shutter 10 is openable and closable in a situation in which the first cover 3*a* is in the closed state. The first linkage mechanism 8*a* is constituted by the first shaft 81, the second shaft 82, the first lever 84, the second lever 85, the third lever 86, the first push member 91, the first urging member 93, and the holding piece 95.

The first shaft 81 extends from one end surface of the shaft portion 10*a* of the shutter 10 coaxially with the shaft portion 10*a*. In the above configuration, the first shaft 81 rotates in the first and second directions R1 and R2 together with the shaft portion 10*a*. The first shaft 81 rotates in the second direction R2 in association with swing of the shutter 10 in the second direction R2 by the own weight of the shutter 10. When the first shaft 81 rotates in the first direction R1, the shutter 10 is in the closed state.

The first lever 84 is fixed to the first shaft 81. The first lever 84 extends in a radially outward direction of the first shaft 81. The first lever 84 swings in the first and second directions R1 and R2 about the first shaft 81 as a swing center. The first lever 84 is a plate-shaped member extending from the first shaft 81 and bent in a substantially C-shape.

The first lever 84 includes a protrusion 84*a*. The protrusion 84*a* is located at a tip end of the first lever 84 (on an opposite side to the first shaft 81). The protrusion 84*a* protrudes in the axial direction of the first shaft 81. The protrusion 84*a* is located at a rear of the first shaft 81 during the shutter 10 being in the open state. The protrusion 84*a* is located above the first shaft 81 during the shutter 10 being in the closed state.

The second shaft 82 is disposed in the left-right direction (in parallel to the shaft portion 10*a*) and supported by the first bearings 80*a* in a pivotal manner. The second shaft 82 rotates in the third and fourth directions R3 and R4 in association with opening and closing of the first cover 3*a*. The second lever 85 is fixed to one end of the second shaft 82 on a side of the shutter 10. The third lever 86 is fixed to the other end of the second shaft 82 on a side opposite to the shutter 10. The second shaft 82 includes a protrusion 82*a*. The protrusion 82*a* protrudes in a radially outward direction of the second shaft 82 from a substantial center of the second shaft 82 in the axial direction of the second shaft 82.

The second lever 85 swings in the third and fourth directions R3 and R4 about the second shaft 82 as a swing center in association with opening and closing of the first cover 3*a*. The second lever 85 includes a flat plate portion 85*a* having a hole 85*b*. The flat plate portion 85*a* is a plate-shaped member. The flat plate portion 85*a* has a substantially fan-like shape as viewed in the left-right direction and extends in the radially outward direction of the second shaft 82. The hole 85*b* passes through the flat plate portion 85*a* in the axial direction of the second shaft 82. The hole 85*b* extends from a center to a tip end (on a side opposite to a side where the second lever 85 is fixed to the second shaft 82) of the flat plate portion 85*a*. The hole 85*b* has a fan-like shape widening toward the tip end of the flat plate portion 85*a*.

The protrusion 84*a* of the first lever 84 is inserted in the hole 85*b* of the second lever 85. Through the insertion, the first lever 84 engages with the second lever 85. In a situation in which the shutter 10 is in the open state, the second lever 85 supports the protrusion 84*a* of the first lever 84 upward. In other words, the protrusion 84*a* of the first lever 84 is in contact with a lower edge of the hole 85*b* of the second lever 85. In the above configuration, the second lever 85 restricts swing of the first lever 84 in the second direction R2. In transition of the first cover 3*a* from the open state to the closed state, the second lever 85 swings in the fourth direction R4. As a result, a tip end of the second lever 85 is located downwardly frontward of the second shaft 82. This removes restriction of swing of the first lever 84 in the second direction R2. In transition of the first cover 3*a* from the closed state to the open state, the second lever 85 swings in the third direction R3. As a result, the tip end of the second lever 85 is located upwardly frontward of the second shaft 82.

The first urging member 93 is disposed between the protrusion 82*a* of the second shaft 82 and the base 80. The first urging member 93 includes an elastic member such as a tension spring or a rubber. The elastic member stretches when the second shaft 82 rotates in the fourth direction R4. That is, the first urging member 93 urges the second shaft 82 in a direction in which the second shaft 82 rotates in the third direction R3. The first urging member 93 rotates the second shaft 82 in the third direction R3 when the first cover 3*a* is opened.

The holding piece 95 is supported by the second shaft 82 in a swingable manner. The holding piece 95 holds the protrusion 84*a* of the first lever 84 in a swingable manner. Specifically, the protrusion 84*a* of the first lever 84 fits into a groove that the holding piece 95 has. The protrusion 84*a* of the first lever 84 slides along the groove of the holding piece 95 to be supported by the holding piece 95. The holding piece 95 prevents the protrusion 84*a* from falling off from the hole 85*b* of the second lever 85.

Figure 4:
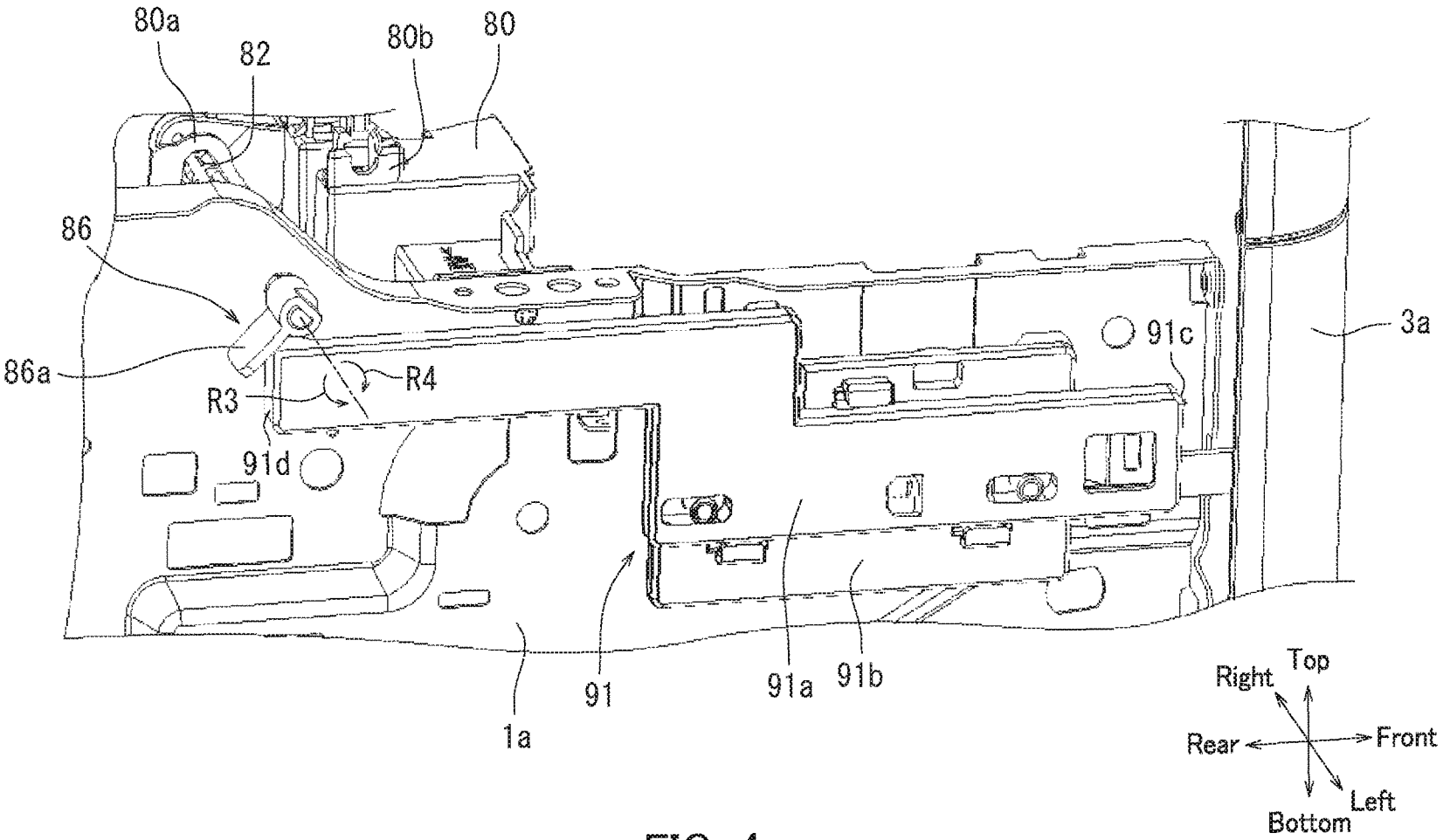
FIG. 4 illustrates the first linkage mechanism in FIG. 3.

FIG. 4 illustrates the first linkage mechanism 8*a*. Specifically, FIG. 4 is a perspective view of the first linkage mechanism 8*a* as viewed downward from the left. Further, FIG. 4 illustrates the first linkage mechanism 8*a* in a situation in which the first cover 3*a* is in the closed state.

As illustrated in FIG. 4, the third lever 86 swings in the third and fourth directions R3 and R4 about the second shaft 82 as a pivot center in association with opening and closing of the first cover 3*a*. The third lever 86 includes a flat plate portion 86*a*.

The flat plate portion 86*a* is a plate-shaped member extending in the radially outward direction of the second shaft 82. In transition of the first cover 3*a* from the open state to the closed state, the third lever 86 swings in the fourth direction R4. As a result, a tip end of the third lever 86 is located downwardly rearward of the second shaft 82. By contrast, in transition of the first cover 3*a* from the closed state to the open state, the third lever 86 swings in the third direction R3 by urging force of the first urging member 93, which is explained with reference to FIG. 3. As a result, the tip end of the third lever 86 is located downwardly frontward of the second shaft 82.

In transition of the first cover 3*a* from the open state to the closed state, the first push member 91 swings the third lever 86 in the fourth direction R4. The first push member 91 includes a contact portion 91*a* and an urging portion 91*b*. The contact portion 91*a* extends between the first cover 3*a* and the third lever 86. The urging portion 91*b* is fixed to a frame 1*a* of the image forming apparatus 1 and supports the contact portion 91*a* in a movable (slidable) manner in the front-to-rear direction. The urging portion 91*b* includes an elastic member that urges the contact portion 91*a* frontward. The elastic member includes for example a pushing spring.

When the first cover 3*a* is closed, the contact portion 91*a* comes in contact at a front edge 91*c* thereof with the first cover 3*a* to move rearward. The contact portion 91*a* that has moved rearward comes in contact at a rear edge 91*d* thereof with the flat plate portion 86*a* of the third lever 86 to swing the third lever 86 in the fourth direction R4. When the first cover 3*a* is opened, the contact portion 91*a* is moved frontward by urging force of the urging portion 91*b* so that the rear edge 91*d* of the contact portion 91*a* is located frontward of the second shaft 82. As a result, the second shaft 82 is rotated in the third direction R3 by the urging force of the first urging member 93, which is described with reference to FIG. 3, to swing the third lever 86 downward.

The first linkage mechanism 8*a* has been described so far. According to the first linkage mechanism 8*a* having the above configuration, the second lever 85 swings in the third direction R3 in association with opening of the first cover 3*a* to rise upwardly frontward. In association with opening of the first cover 3*a* in a situation in which the shutter 10 is in the open state, the protrusion 84*a* of the first lever 84 is raised to swing the first lever 84 in the first direction R1. As a result, the first shaft 81 (shaft portion 10*a*) rotates in the first direction R1. Through the above, the shutter 10 is in the closed state.

Figure 5:
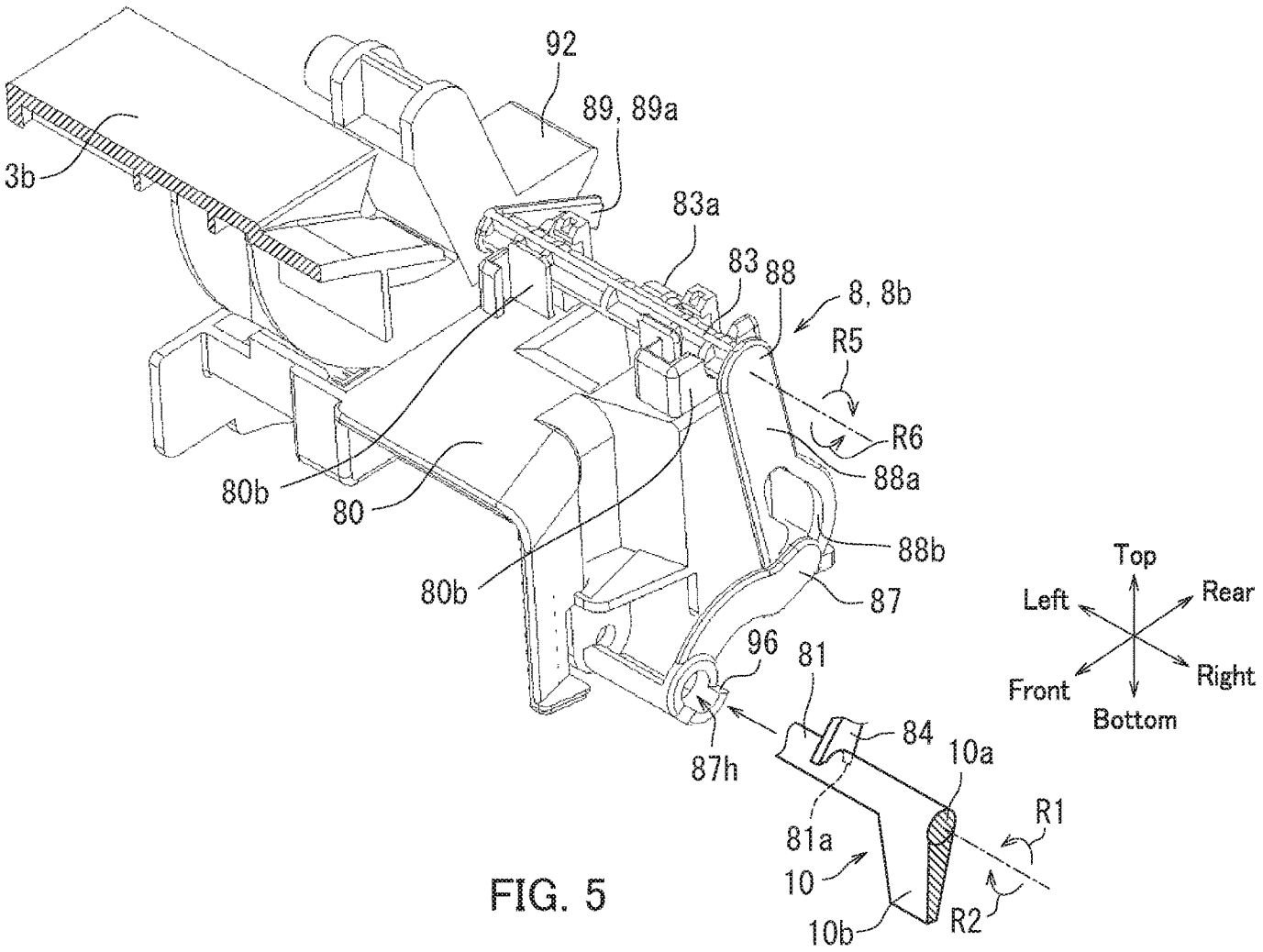
FIG. 5 illustrates configuration of a second linkage mechanism of the linkage mechanism according to the embodiment of the present disclosure.

The second linkage mechanism will be described next in detail with reference to FIGS. 5 and 6. FIG. 5 illustrates configuration of the second linkage mechanism 8*b*. Specifically, FIG. 5 is a perspective view of the second linkage mechanism 8*b* as viewed downward from the right front. Further, FIG. 5 illustrates the second linkage mechanism 8*b* in a situation in which the second cover 3*b* is in the closed state.

As illustrated in FIG. 5, the linkage mechanism 8 further includes a third shaft 83, a fourth lever 87, a fifth lever 88, a sixth lever 89, and a second push member 92.

The second linkage mechanism 8*b* links the second cover 3*b* to the shutter 10. When the second cover 3*b* is opened, the second linkage mechanism 8*b* rotates the shaft portion 10*a* of the shutter 10 in the first direction R1 to set the shutter 10 in the closed state. When the second cover 3*b* is closed, the second linkage mechanism 8*b* sets the shaft portion 10*a* of the shutter 10 rotatable. In other words, the shutter 10 is openable and closable in a situation in which the second cover 3*b* is in the closed state. The second linkage mechanism 8*b* is constituted by the first shaft 81, the third shaft 83, the fourth lever 87, the fifth lever 88, the sixth lever 89, and the second push member 92. The second push member 92 is integral with a rear edge of the second cover 3*b*. The second push member 92 is located rearward of the rotational axis of the second cover 3*b*.

The first shaft 81 includes a contact target portion 81*a*. The contact target portion 81*a* protrudes in the radially outward direction of the first shaft 81. The contact target portion 81*a* in the present embodiment is integral with a base end of the first lever 84.

The third shaft 83 is disposed in the left-right direction (in parallel to the shaft portion 10*a*) and supported by the second bearings 80*b* in a rotatable manner. The third shaft 83 rotates in the fifth and sixth directions R5 and R6 in association with opening and closing of the second cover 3*b*. The fifth lever 88 is fixed to one end of the third shaft 83 that is located on a side of the shutter 10. The sixth lever 89 is fixed to the other end of the third shaft 83 on a side opposite to the shutter 10. The third shaft 83 includes a protrusion 83*a*. The protrusion 83*a* protrudes in a radially outward direction of the third shaft 83 from a substantial center of the third shaft 83 in the axial direction thereof.

The sixth lever 89 swings in the fifth and sixth directions R5 and R6 about the third shaft 83 as a swing center in association with opening and closing of the second cover 3*b*. The sixth lever 89 includes a flat plate portion 89*a*. The flat plate portion 89*a* is a plate-shaped member extending in the radially outward direction of the third shaft 83. In transition of the second cover 3*b* from the open state to the closed state, the sixth lever 89 swings in the sixth direction R6. As a result, a tip end of the sixth lever 89 is located rearward of the third shaft 83. In transition of the second cover 3*b* from the closed state to the open state, the sixth lever 89 swings in the fifth direction R5. As a result, the tip end of the sixth lever 89 is located downward of the third shaft 83.

Figure 6:
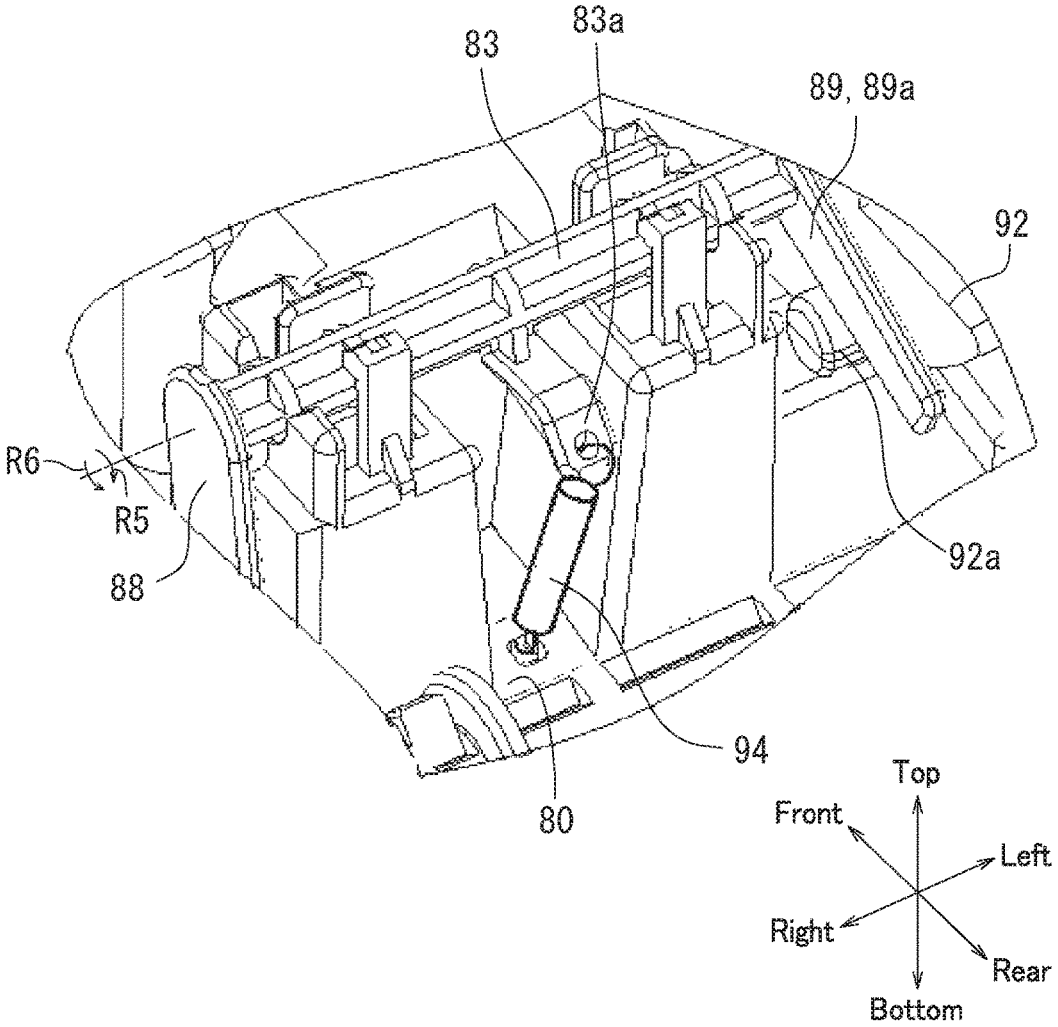
FIG. 6 illustrates the second linkage mechanism in FIG. 5.

FIG. 6 illustrates the second linkage mechanism of FIG. 5. Specifically, FIG. 6 is a perspective view of the second linkage mechanism 8*b* as viewed frontward from the right. The linkage mechanism 8 further includes a second urging member 94. The second urging member 94 constitutes the second linkage mechanism 8*b*. As illustrated in FIG. 6, the second urging member 94 is disposed between the base 80 and the protrusion 83*a* of the third shaft 83. The second urging member 94 includes an elastic member such as a tension spring or a rubber. The second urging member 94 urges the third shaft 83 in a direction in which the third shaft 83 rotates in the fifth direction R5. In other words, the second urging member 94 (elastic member) is stretched when the third shaft 83 rotates in the sixth direction R6.

The second push member 92 includes a jut 92*a*. The jut 92*a* protrudes in the axial direction of the third shaft 83 and is capable of coming into contact with the sixth lever 89 (a lower end of the flat plate portion 89*a*). When the second cover 3*b* is opened, the second push member 92 (jut 92*a*) moves frontward. Through the frontward movement of the second push member 92, pushing force toward the sixth lever 89 (by the jut 92*a*) is removed. As a result, the third shaft 83 is rotated in the fifth direction R5 by urging force of the second urging member 94. By contrast, when the second cover 3*b* is closed, the second push member 92 (jut 92*a*) moves rearward. Through the rearward movement of the second push member 92, the sixth lever 89 is pushed by the jut 92*a*. As a result, the third shaft 83 rotates in the sixth direction R6 against the urging force of the second urging member 94.

As illustrated in FIG. 5, the fifth lever 88 swings in the fifth and sixth directions R5 and R6 about the third shaft 83 as a swing center in association with opening and closing of the second cover 3*b*. The fifth lever 88 includes a flat plate portion 88*a* having a hole 88*b*. The flat plate portion 88*a* extends in the radially outward direction of the third shaft 83. The hole 88*b* passes through the flat plate portion 88*a* in the axial direction of the third shaft 83. The hole 88*b* extends from a center to a tip end of the flat plate portion 88*a* as viewed in the left-right direction. In transition of the second cover 3*b* from the open state to the closed state, the fifth lever 88 swings in the sixth direction R6. As a result, a tip end of the fifth lever 88 is located downward of the third shaft 83. In transition of the second cover 3*b* from the closed state to the open state, the fifth lever 88 swings in the fifth direction R5. As a result, the tip end of the fifth lever 88 is located frontward of the third shaft 83.

The fourth lever 87 has a hole 87*h* at an end portion (also referred to below as a base end portion) thereof. The first shaft 81 is inserted in the hole 87*h* of the fourth lever 87 to slides thereon. In the above configuration, the fourth lever 87 is swingable about the first shaft 81 as a swing center. The fourth lever 87 is a flat plate-shaped member and bent in a substantially C shape. The fourth lever 87 includes a protrusion at a tip end thereof (on a side opposite to the base end portion) that protrudes in the axial direction of the first shaft 81. The protrusion is inserted in the hole 88*b* of the fifth lever 88. Through the insertion of the protrusion to the hole 88*b*, the fourth lever 87 engages with the fifth lever 88. In transition of the second cover 3*b* from the open state to the closed state, the fourth lever 87 swings in the second direction R2 in association with swing of the fifth lever 88 in the sixth direction R6. As a result, a tip end of the fourth lever 87 is located rearward of the first shaft 81. In transition of the second cover 3*b* from the closed state to the open state, the fourth lever 87 swings in the first direction R1 in association with swing of the fifth lever 88 in the fifth direction R5. As a result, the tip end of the fourth lever 87 is located upward of the first shaft 81.

The second linkage mechanism 8*b* further includes a contact portion 96. The contact portion 96 is located at the base end portion of the fourth lever 87. The contact portion 96 protrudes in the radially outward direction of the first shaft 81 along a circumferential surface of the first shaft 81. The contact portion 96 has a substantially arc shape as viewed in the left-right direction. The contact portion 96 in the present embodiment is integral with the base end portion of the fourth lever 87.

The contact portion 96 rotates in the first and second directions R1 and R2 about the first shaft 81 as a rotation center in association with opening and closing of the second cover 3*b*. When the fourth lever 87 swings in the first direction R1 in a situation in which the shutter 10 is in the open state, the contact portion 96 comes in contact with (abuts on) the contact target portion 81*a* of the first shaft 81 to rotate the first shaft 81 (shaft portion 10*a*) in the first direction R1. As a result, the shutter 10 is closed. By contrast, the contact portion 96 is out of contact with the contact target portion 81*a* in a situation in which the second cover 3*b* and the shutter 10 each are in the closed state.

Figure 7:
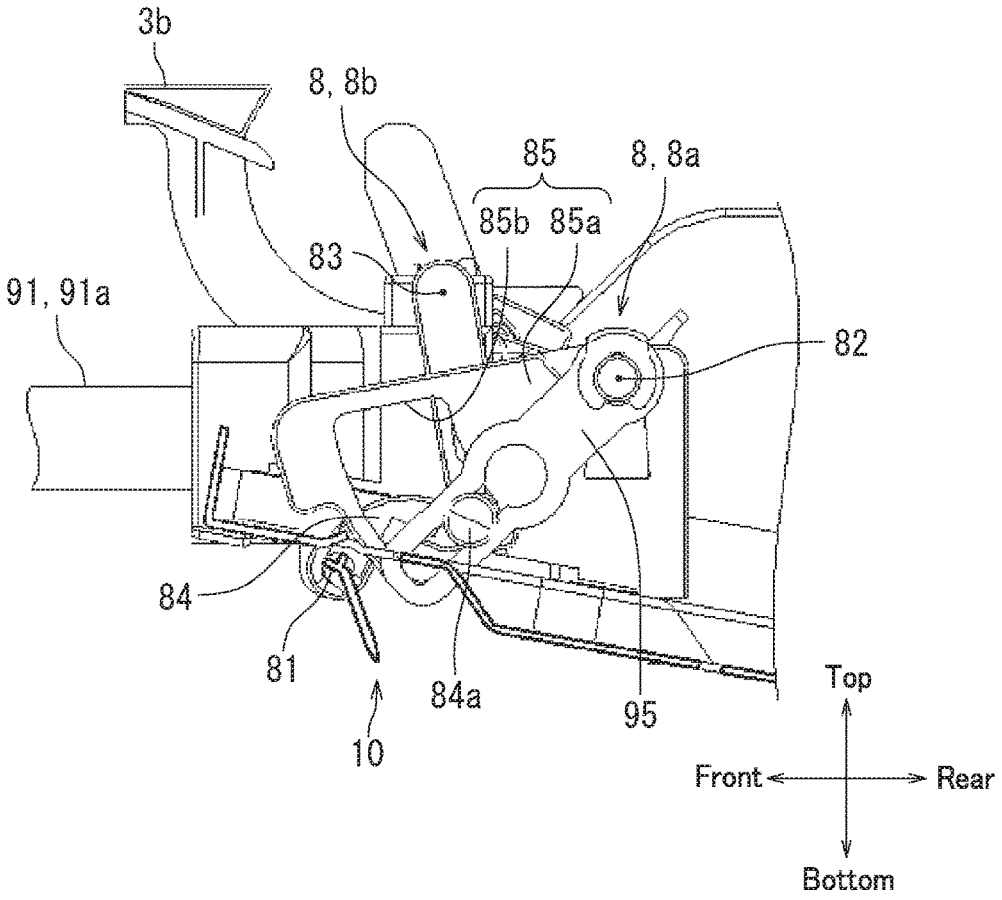
FIG. 7 illustrates the linkage mechanism in a situation in which a first cover and a second cover each are in a closed state in the embodiment of the present disclosure.
Figure 8:
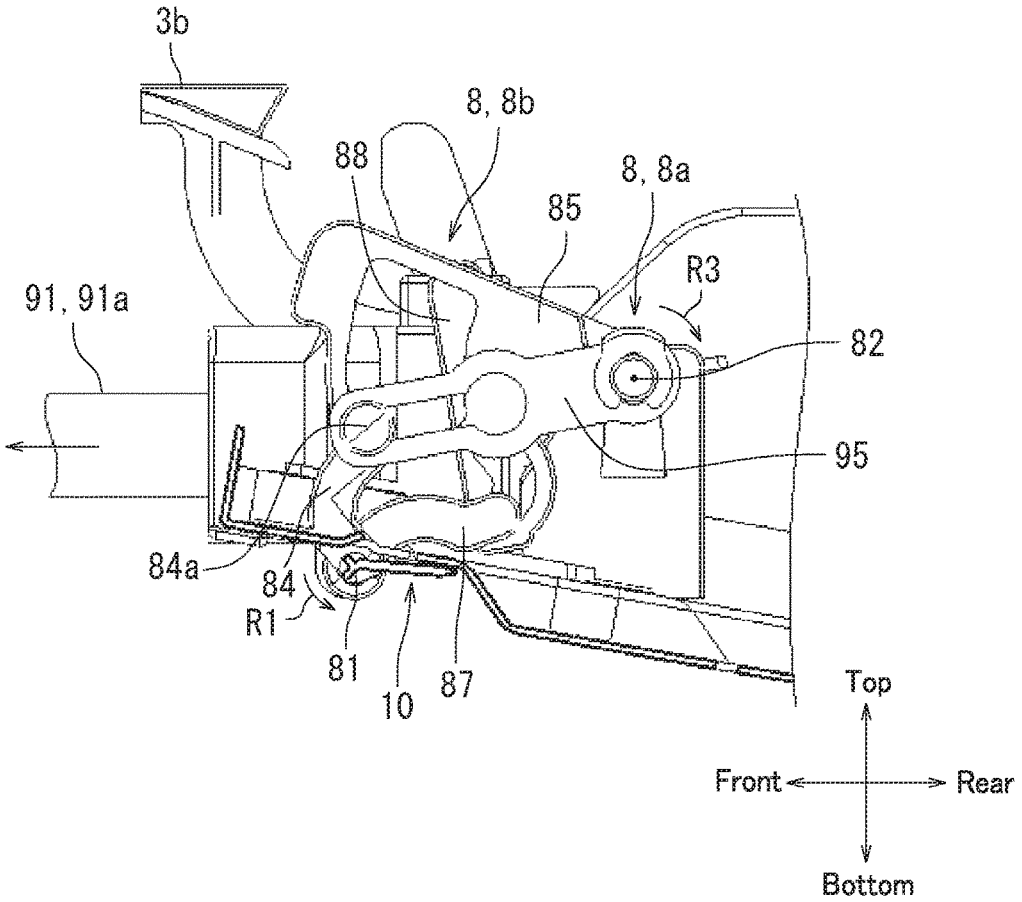
FIG. 8 illustrates the linkage mechanism after transition of the first cover from a closed state to an open state in a situation in which the second cover is in a closed state in the embodiment of the present disclosure.
Figure 9:
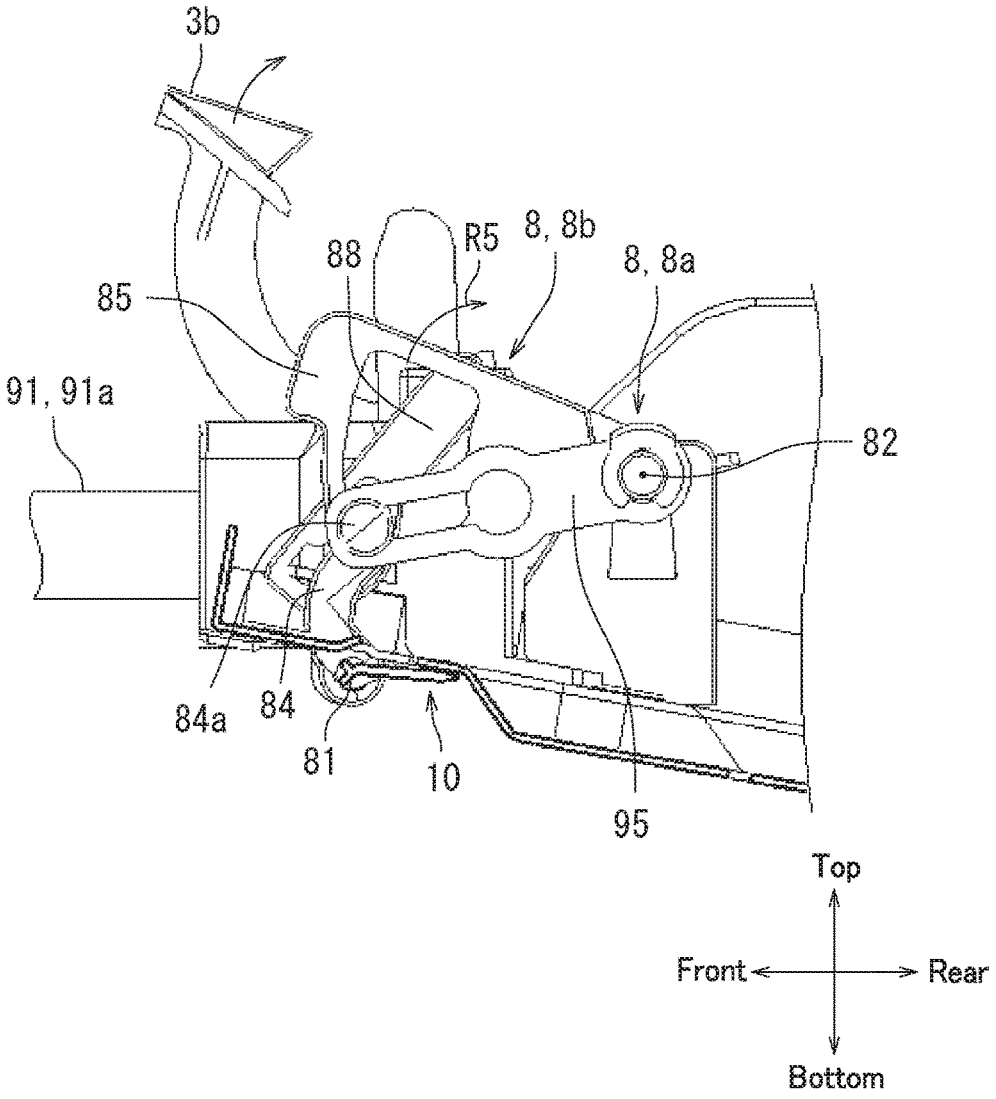
FIG. 9 illustrates the linkage mechanism after transition of the second cover from the closed state to an open state in a situation in which the first cover is in the open state in the embodiment of the present disclosure.

Operation of the linkage mechanism 8 will be described next with reference to FIGS. 3-14. Description will be made first with reference to FIGS. 7-9 about operation of the linkage mechanism 8 in transition of the first and second covers 3*a* and 3*b* from the closed state to the open state. FIG. 7 illustrates the linkage mechanism 8 in a situation in which the first and second covers 3*a* and 3*b* each are in the closed state. FIG. 8 illustrates the linkage mechanism 8 after transition of the first cover 3*a* from the closed state to the open state in a situation in which the second cover 3*b* is in the closed state. FIG. 9 illustrates the linkage mechanism 8 after transition of the second cover 3*b* from the closed state to the open state in a situation in which the first cover 3*a* is in the open state. Note that the first cover 3*a* is not illustrated in FIGS. 7-9.

As illustrated in FIG. 7, in a situation in which the first and second covers 3*a* and 3*b* each are in the closed state, the linkage mechanism 8 sets the shutter 10 to be openable and closable. The shutter 10 is accordingly in the open state by its own weight.

In order to open the second cover 3*b*, it is necessary to first open the first cover 3*a* in the present embodiment. When the first cover 3*a* transitions from the closed state to the open state in a situation in which the second cover 3*b* is in the closed state, the linkage mechanism 8 sets the shutter 10 in the closed state, as illustrated in FIG. 8. When the first cover 3*a* is opened, the contact portion 91*a* of the first push member 91 is moved frontward by the urging force of the urging portion 91*b*, as described with reference to FIGS. 3 and 4. When the contact portion 91*a* moves frontward, the second shaft 82 is rotated in the third direction R3 by the urging force of the first urging member 93. Rotation of the second shaft 82 accompanies swing of the second lever 85 in the third direction R3 to swing the first lever 84, which engages with the second lever 85, in the first direction R1. As a result, the first shaft 81 (shaft portion 10*a*) rotates in the first direction R1 to set the shutter 10 in the closed state.

In a situation in which the first cover 3*a* is in the open state while the shutter 10 is in the closed state, the first lever 84 (protrusion 84*a*) located upwardly frontward of the first shaft 81 is in contact with the second lever 85 (lower edge of the hole 85*b*) located upwardly frontward of the second shaft 82. That is, the second lever 85 restricts swing of the first lever 84 in the first direction R1. Through the above, the linkage mechanism 8 maintains the closed state of the shutter 10 independent of opening and closing of the second cover 3*b*.

In the above configuration, even in transition of the second cover 3*b* from the closed state to the open state in a situation in which the first cover 3*a* is in the open state, the closed state of the shutter 10 is maintained, as illustrated in FIG. 9. When the second cover 3*b* is opened, the sixth lever 89 swings in the fifth direction R5 by the urging force of the second urging member 94, as has been described with reference to FIGS. 5 and 6. Swing of the sixth lever 89 in the fifth direction R5 accompanies swing of the fifth lever 88 in the fifth direction R5 through the third shaft 83. Swing of the fifth lever 88 in the fifth direction R5 swings the fourth lever 87 in the first direction R1 to cause the contact portion 96 of the fourth lever 87 to come in contact with the contact target portion 81*a* of the first shaft 81.

Figure 10:
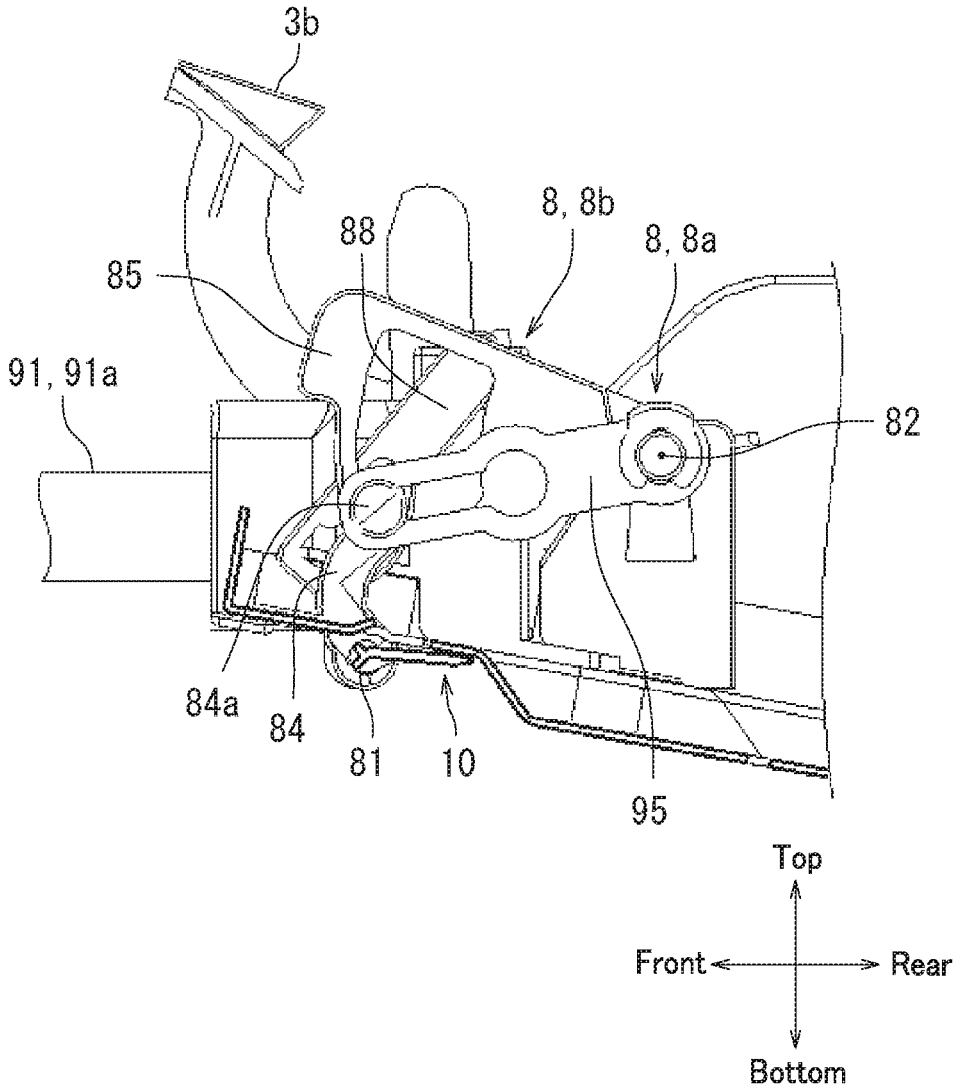
FIG. 10 illustrates the linkage mechanism in a situation in which the first and second covers each are in the open state in the embodiment of the present disclosure.
Figure 11:
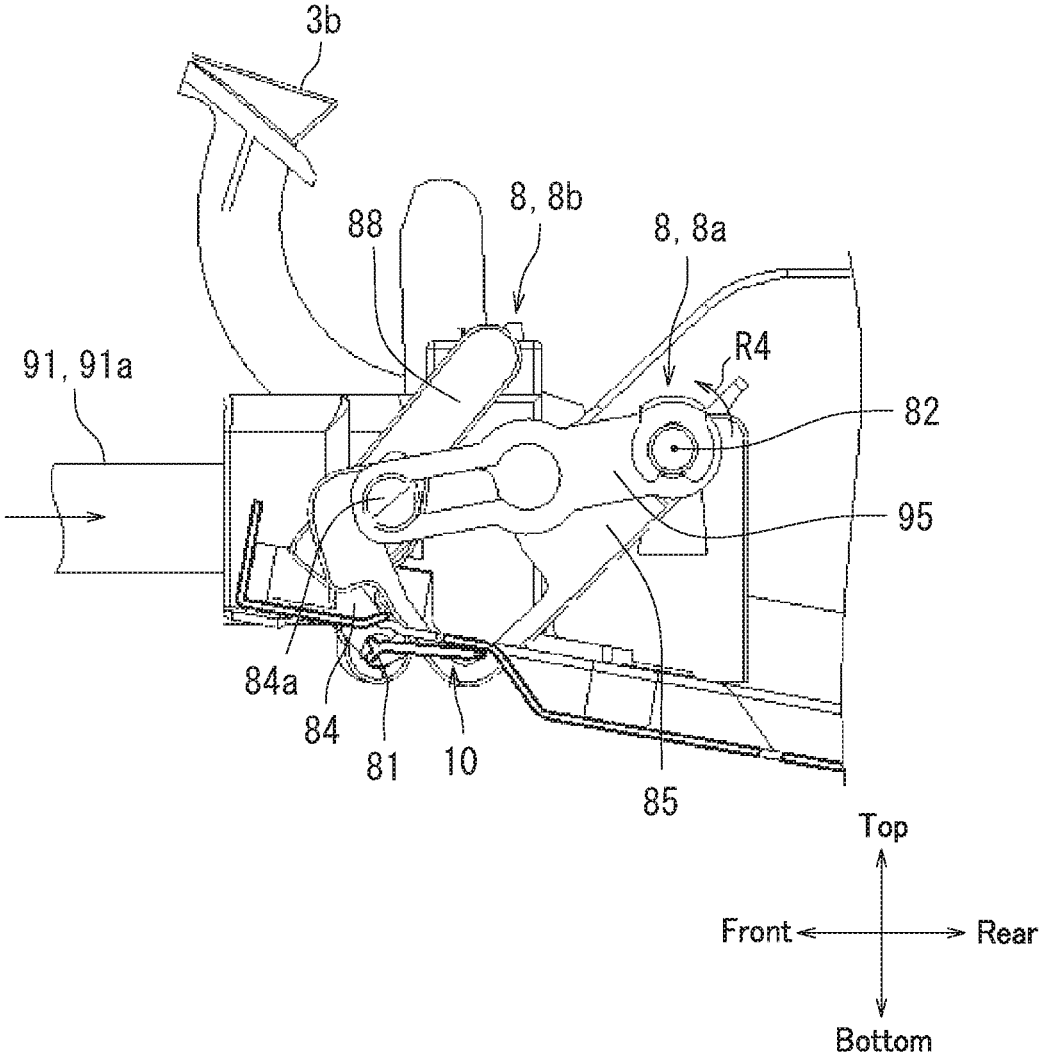
FIG. 11 illustrates the linkage mechanism after transition of the first cover from the open state to the closed state in a situation in which the second cover is in the open state in the embodiment of the present disclosure.
Figure 12:
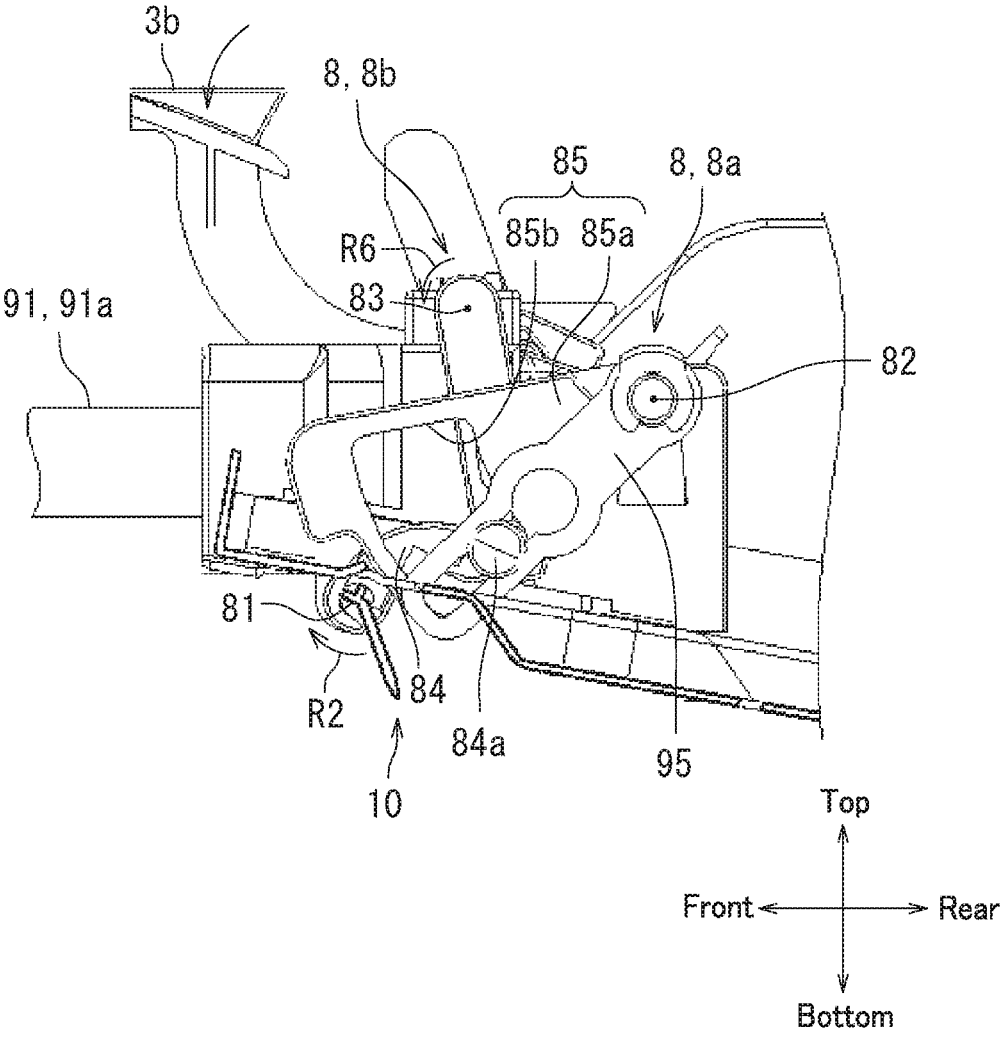
FIG. 12 illustrates the linkage mechanism after transition of the second cover from the open state to the closed state in a situation in which the first cover is in the closed state in the embodiment of the present disclosure.

Description will be made next with reference to FIGS. 10-12 about operation of the linkage mechanism 8 in transition of the second cover 3*b* from the open state to the closed state after transition of the first cover 3*a* from the open state to the closed state. FIG. 10 illustrates the linkage mechanism 8 in a situation in which the first and second covers 3*a* and 3*b* each are in the open state. FIG. 11 illustrates the linkage mechanism 8 after transition of the first cover 3*a* from the open state to the closed state in a situation in which the second cover 3*b* is in the open state. FIG. 12 illustrates the linkage mechanism 8 after transition of the second cover 3*b* from the open state to the closed state in a situation in which the first cover 3*a* is in the closed state. Note that the first cover 3*a* is not illustrated in FIGS. 10-12.

As illustrated in FIG. 10, in a situation in which the first and second covers 3*a* and 3*b* each are in the open state, the protrusion 84*a* of the first lever 84 is in contact with the lower edge of the hole 85*b* of the second lever 85. In the above configuration, even when the second cover 3*b* is closed in a situation in which the first cover 3*a* is in the open state, the first linkage mechanism 8*a* maintains the closed state of the shutter 10. Further, in a situation in which the first and second covers 3*a* and 3*b* each are in the open state, the contact portion 96 of the fourth lever 87 is in contact with the contact target portion 81*a* of the first shaft 81, as has been described with reference to FIGS. 5 and 9. In the above configuration, even when the first cover 3*a* is closed in a situation in which the second cover 3*b* is in the open state, the second linkage mechanism 8*b* maintains the closed state of the shutter 10.

Accordingly, even in transition of the first cover 3*a* from the open state to the closed state in a situation in which the second cover 3*b* is in the open state, the closed state of the shutter 10 is maintained, as illustrated in FIG. 11. Specifically, when the first cover 3*a* is closed, the contact portion 91*a* of the first push member 91 moves rearward to swing the third lever 86 in the fourth direction R4, as has been described with reference to FIGS. 3 and 4. Swing of the third lever 86 in the fourth direction R4 swings the second lever 85 in the fourth direction R4 through the second shaft 82. However, the contact portion 96 of the fourth lever 87 is in contact with the contact target portion 81*a* of the first shaft 81, thereby restricting rotation of the first shaft 81. As a result, the closed state of the shutter 10 is maintained. Accordingly, the first lever 84 does not swing and the protrusion 84*a* does not change in position. During the second lever 85 swinging in the fourth direction R4, the protrusion 84*a* of the first lever 84 relatively moves in the hole 85*b* of the second lever 85.

As illustrated in FIG. 12, when the second cover 3*b* transitions from the open state to the closed state in a situation in which the first cover 3*a* is in the closed state, the shutter 10 is openable and closable. Specifically, when the second cover 3*b* is closed, the jut 92*a* of the second push member 92 pushes the sixth lever 89, as has been described with reference to FIGS. 5 and 6. The sixth lever 89 pushed by the jut 92*a* rotates the third shaft 83 in the sixth direction R6 to swing the fifth lever 88 in the sixth direction R6. Swing of the fifth lever 88 in the sixth direction R6 swings the fourth lever 87 in the second direction R2. Through the above, engagement between the contact portion 96 of the fourth lever 87 and the contact target portion 81*a* of the first shaft 81 is released. As a result, the first shaft 81 is allowed to rotate in the second direction R2. The shutter 10 accordingly swings in the second direction R2 by its own weight to be in the open state.

Figure 13:
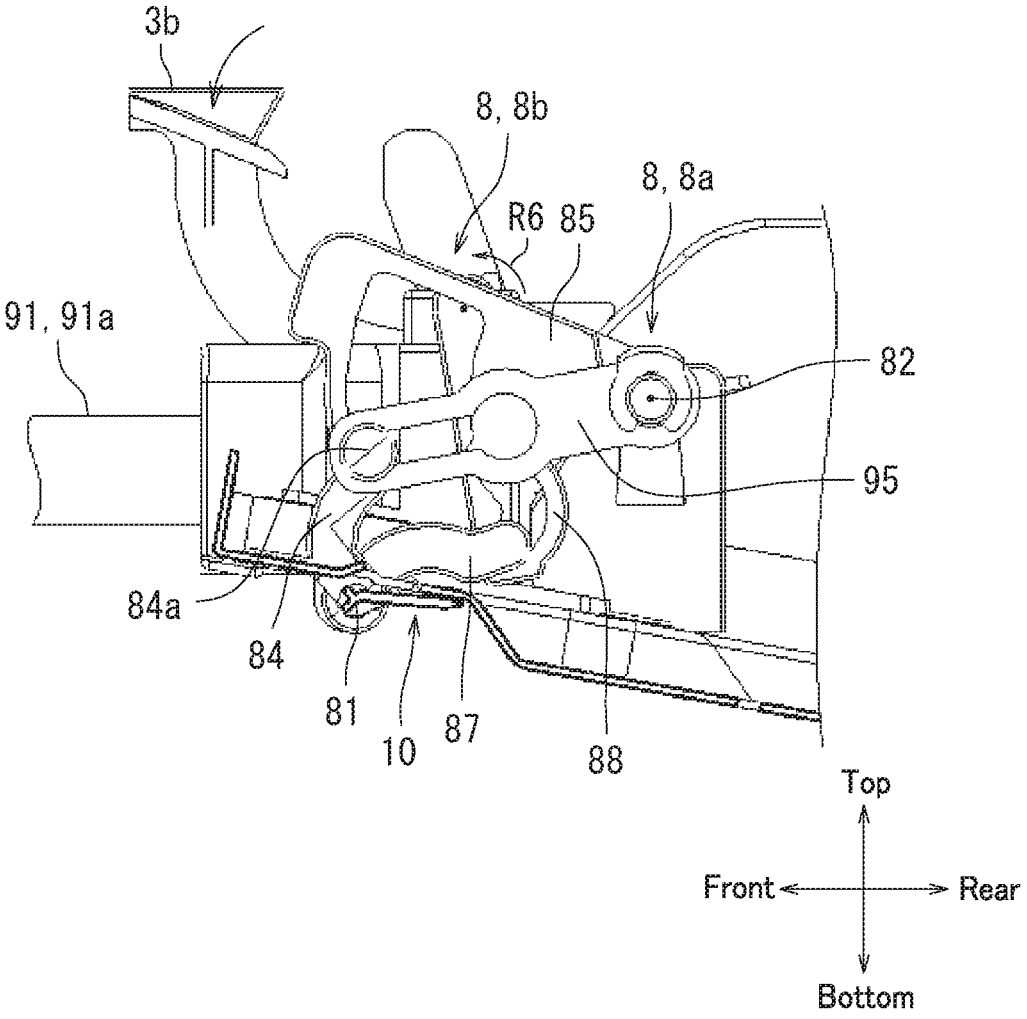
FIG. 13 illustrates the linkage mechanism after transition of the second cover from the open state to the closed state in a situation in which the first cover is in the open state in the embodiment of the present disclosure.
Figure 14:
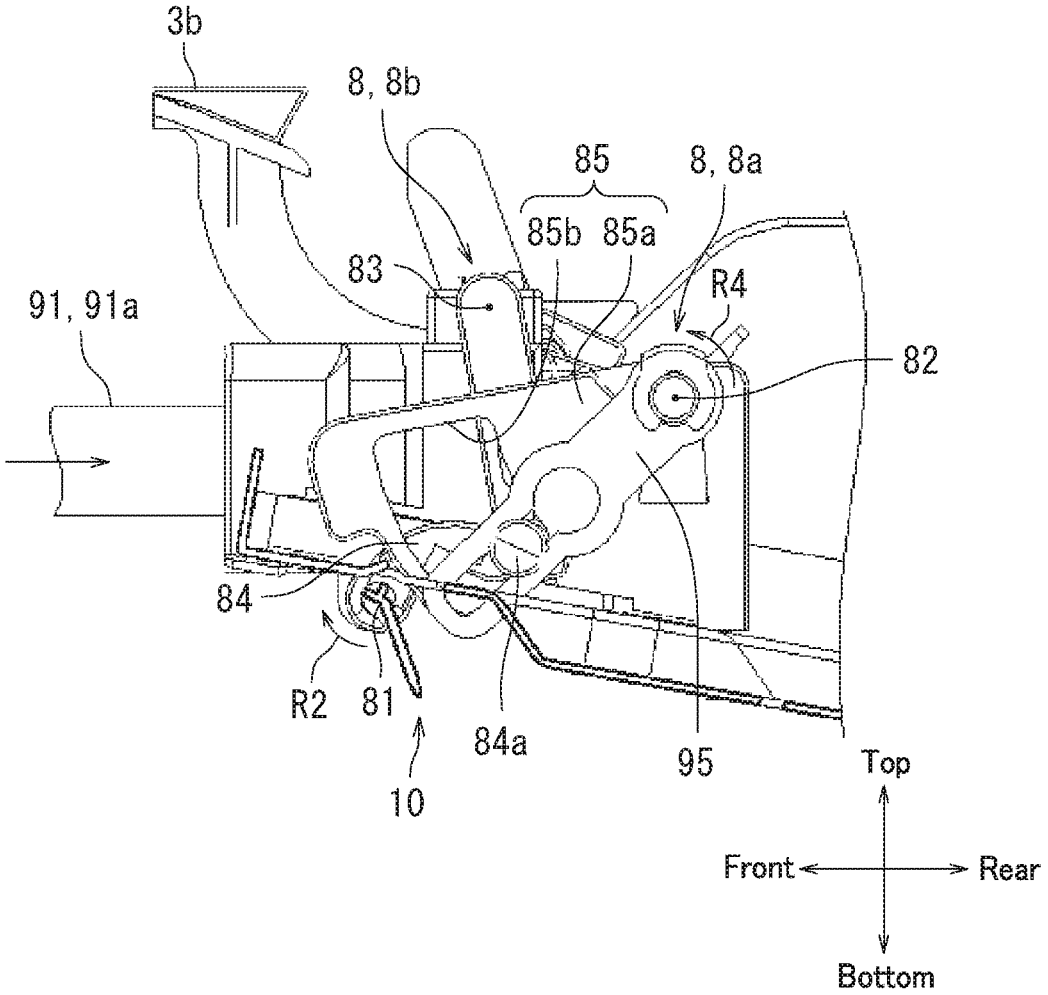
FIG. 14 illustrates the linkage mechanism after transition of the first cover from the open state to the closed state in a situation in which the second cover is in the closed state in the embodiment of the present disclosure.

Description will be made next about operation of the linkage mechanism 8 in transition of the first cover 3*a* from the open state to the closed state after the second cover 3*b* transitions from the open state to the closed state. FIG. 13 illustrates the linkage mechanism 8 after transition of the second cover 3*b* from the open state to the closed state in a situation in which the first cover 3*a* is in the open state. FIG. 14 illustrates the linkage mechanism 8 after transition of the first cover 3*a* from the open state to the closed state in a situation in which the second cover 3*b* is in the closed state. Note that the first cover 3*a* is not illustrated in FIGS. 13 and 14.

As illustrated in FIG. 13, when the second cover 3*b* transitions from the open state to the closed state in a situation in which the first cover 3*a* is in the open state, the closed state of the shutter 10 is maintained. Specifically, when the second cover 3*b* transitions from the open state to the closed state, the jut 92*a* of the second push member 92 pushes the sixth lever 89, as has been described with reference to FIGS. 5 and 6. When the sixth lever 89 is pushed by the jut 92*a*, the sixth lever 89 pushed by the jut 92*a* rotates the third shaft 83 to swing the fifth lever 88 in the sixth direction R6 against the urging force of the second urging portion 94. Swing of the fifth lever 88 in the sixth direction R6 swings the fourth lever 87 in the second direction R2. By contrast, the protrusion 84*a* of the first lever 84, which is in contact with the lower edge of the hole 85*b* of the second lever 85, restricts rotation of the first shaft 81. As a result, the closed state of the shutter 10 is maintained. In the above situation, contact between the contact portion 96 of the fourth lever 87 and the contact target portion 81*a* of the first shaft 81 is lost.

When the first cover 3*a* transitions from the open state to the closed state in a situation in which the second cover 3*b* is in the closed state, the linkage mechanism 8 sets the shutter 10 openable and closable, as illustrated in FIG. 14. Specifically, when the first cover 3*a* is closed, the contact portion 91*a* of the first push member 91 moves rearward to swing the third lever 86 in the fourth direction R4, as has been described with reference to FIGS. 3 and 4. Swing of the third lever 86 swings the second lever 85 in the fourth direction R4 through the second shaft 82. Contact between the protrusion 84*a* of the first lever 84 and the lower edge of the hole 85*b* of the second lever 85 is accordingly lost (restriction of swing of the first lever 84 in the second direction R2 by the second lever 85 is removed) to allow rotation of the first shaft 81 in the second direction R2. As a result, the shutter 10 swings in the second direction R2 by its own weight to be in the open state.

According to the image forming apparatus 1 in the present embodiment, the linkage mechanism 8 closes the shutter 10 when the first cover 3*a* is opened. Further, when the first and second covers 3*a* and 3*b* each are closed, the linkage mechanism 8 opens the shutter 10. In the above configuration, even if a user closes either the first cover 3*a* or the second cover 3*b* first, external leakage of the laser light L from the casing 2 can be prevented. As a result, the user is allowed to close the first and second covers 3*a* and 3*b* in any order, thereby enhancing user friendliness.

The present embodiment has been explained so far with reference to FIGS. 1-14. However, the present disclosure is not limited to the above embodiment and can be practiced in various ways without departing from the scope of the present disclosure. For example, the shutter 10 swings by its own weight to be in the open state in the embodiment of the present disclosure, which however should not be taken to limit the present disclosure. The shutter 10 may swing for example by an urging member or a drive section to be in the open state. The urging member urges the shutter 10 into the open state. The drive section drives the shutter 10 into the open state.

Note that the drawings are schematic illustrations that emphasize elements of configuration in order to facilitate understanding thereof. Therefore, in order that the elements of configuration can be easily illustrated in the drawings, properties of each of the element, such as thickness and length thereof, may differ from actual properties of the element. Material properties of elements of configuration, such as shapes, in the above embodiment are merely examples that do not impose any particular limitations and can be altered in various ways to the extent that there is not substantial deviation from the effects of the present disclosure.

What is claimed is:

1. An image forming apparatus comprising:

a casing;

an image forming unit including a light source and disposed in an interior of the casing, the image forming unit being configured to form an image on a recording medium;

a plurality of covers each openable and closable relative to the casing;

a shutter openable and closable relative to the light source; and a linkage mechanism that links the respective covers to the shutter, the linkage mechanism setting the shutter in a closed state in a situation in which at least one of the covers is in an open state, the linkage mechanism setting the shutter in an open state in a situation in which all the covers are in a closed state, wherein the plurality of covers includes:

a first cover; and a second cover that is openable in a situation in which the first cover is in an open state, the linkage mechanism includes:

a first shaft configured to rotate in association with opening and closing of the shutter; and a contact portion configured to rotate about the first shaft as a rotation center in association with opening and closing of the second cover, the first shaft includes a contact target portion with which the contact portion comes in contact, the contact portion protrudes in a radially outward direction of the first shaft portion, and in a situation in which the second cover is in an open state, the contact portion is in contact with the contact target portion in a manner that the closed state of the shutter is maintained.

2. The image forming apparatus according to claim 1, wherein the linkage mechanism includes:

a first lever configured to swing in association with opening and closing of the shutter; and a second lever configured to swing in association with opening and closing of the first cover, and in a situation in which the first cover is in the open state, the first lever engages with the second lever in a manner that the closed state of the shutter is maintained.

3. The image forming apparatus according to claim 2, wherein the linkage mechanism further includes:

a second shaft configured to rotate in association with opening and closing of the first cover; and a holding piece supported by the second shaft in a swingable manner and configured to hold a tip end of the first lever in a swingable manner.

4. The image forming apparatus according to claim 3, wherein when the first cover is closed, the second shaft rotates in one direction, and the linkage mechanism further includes an urging member that urges the second shaft to a direction opposite to the one direction.

5. The image forming apparatus according to claim 1, wherein the linkage mechanism includes:

a second shaft configured to rotate in association with opening and closing of the second cover; and an urging member, when the second cover is closed, the second shaft rotates in one direction, and the urging member urges the second shaft in a direction opposite to the one direction.

6. The image forming apparatus according to claim 5, wherein the shutter includes:

a third shaft capable of rotating in a first direction and a second direction; and a flat plate portion having a flat plate-like shape extending in an axial direction of the third shaft, when the third shaft rotates in the first direction, the flat plate portion blocks a light path of light emitted from the light source, and when the third shaft rotates in the second direction, the flat plate portion unblocks the light path.

7. The image forming apparatus according to claim 6, wherein the third shaft rotates in the second direction by an own weight of the flat plate portion.

8. An image forming apparatus comprising:

a casing;

an image forming unit including a light source and disposed in an interior of the casing, the image forming unit being configured to form an image on a recording medium;

a plurality of covers each openable and closable relative to the casing;

a shutter openable and closable relative to the light source; and a linkage mechanism that links the respective covers to the shutter, wherein the linkage mechanism sets the shutter in a closed state in a situation in which at least one of the covers is in an open state and sets the shutter in an open state in a situation in which all the covers are in a closed state, the shutter includes:

a shaft capable of rotating in a first direction and a second direction; and a flat plate portion having a flat plate-like shape extending in an axial direction of the shaft, when the shaft rotates in the first direction, the flat plate portion blocks a light path of light emitted from the light source, and when the shaft rotates in the second direction, the flat plate portion unblocks the light path.

9. The image forming apparatus according to claim 8, wherein the shaft rotates in the second direction by an own weight of the flat plate portion.

* * * * *